US009305556B2

(12) United States Patent
Kim et al.

(10) Patent No.: US 9,305,556 B2
(45) Date of Patent: Apr. 5, 2016

(54) APPARATUS AND METHOD FOR ENCODING AND DECODING MULTI-CHANNEL AUDIO SIGNAL

(75) Inventors: Mi Young Kim, Hwaseong-si (KR); Jung Hoe Kim, Hwaseong-si (KR); Ho Sang Sung, Yongin-si (KR); Ki Hyun Choo, Seoul (KR); Eun Mi Oh, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1134 days.

(21) Appl. No.: 13/183,858

(22) Filed: Jul. 15, 2011

(65) Prior Publication Data

US 2012/0020482 A1 Jan. 26, 2012

(30) Foreign Application Priority Data

Jul. 22, 2010 (KR) ..... 10-2010-0071040

(51) Int. Cl.
*H04R 5/00* (2006.01)
*G10L 19/008* (2013.01)

(52) U.S. Cl.
CPC ..... *G10L 19/008* (2013.01)

(58) Field of Classification Search
CPC ..... G10L 19/008; H04H 20/89; H04S 3/02
USPC ..... 381/1–3, 17–23, 27; 700/94; 704/205, 704/207, 200, 500, 503
See application file for complete search history.

(56) References Cited

U.S. PATENT DOCUMENTS

2004/0049379 A1* 3/2004 Thumpudi et al. ..... 704/205
2009/0110203 A1* 4/2009 Taleb ..... 381/17
2011/0317842 A1* 12/2011 Neusinger et al. ..... 381/22

FOREIGN PATENT DOCUMENTS

EP 1175030 A2 1/2002
JP 2002-204170 7/2002
JP 2005-062296 3/2005
JP 2008-310238 12/2008
KR 10-2006-0109299 10/2006
KR 10-2007-0003600 1/2007
KR 10-2007-0050035 5/2007
KR 10-0932790 12/2009
WO 2006/072270 A1 7/2006

OTHER PUBLICATIONS

J0rgen Herre et al., "MPEG Surround—The ISO/MPEG Standard for Efficient and Compatible Multi-Channel Audio Coding", Audio Engineering Society, Presented at the 122nd Convention, May 2007, pp. 1-23.*

(Continued)

*Primary Examiner* — Lun-See Lao
(74) *Attorney, Agent, or Firm* — Staas & Halsey LLP

(57) ABSTRACT

Disclosed is an apparatus for encoding and decoding a multi-channel audio signal. The apparatus for encoding the multi-channel audio signal groups channels of a multi-channel audio signal, eliminates redundant information between channels using a mixing matrix including phase information, converts a frequency of the signal, and encodes the signal.

20 Claims, 8 Drawing Sheets

(56) References Cited

OTHER PUBLICATIONS

European Search Report dated Dec. 28, 2011 issued in corresponding European Patent Application No. 11173432.3.

Jürgen Herre et al., "MPEG Surround—The ISO/MPEG Standard for Efficient and Compatible Multi-Channel Audio Coding", Audio Engineering Society, Presented at the 122nd Convention, May 2007, pp. 1-23.

Dai Yang et al., "An Inter-Channel Redundancy Removal Approach for High-Quality Multichannel Audio Compression", Audio Engineering Society, Presented at the 109th Convention, Sep. 2000, pp. 1-14.

* cited by examiner

APPARATUS AND METHOD FOR ENCODING AND DECODING MULTI-CHANNEL AUDIO SIGNAL

CROSS-REFERENCE TO RELATED APPLICATIONS

This application claims the priority benefit of Korean Patent Application No. 10-2010-0071040, filed on Jul. 22, 2010, in the Korean Intellectual Property Office, the disclosure of which is incorporated herein by reference.

BACKGROUND

1. Field

Example embodiments relate to a method of compressing and reconstructing a multi-channel audio signal.

2. Description of the Related Art

Due to recent developments of a multi-channel audio service, channels of input audio signals, such as a 10.3 channel and a 22.2 channel, tend to increase in number. When a number of channels increases, an amount of bit streams to be transmitted also increases. However, an existing infrastructure cannot support the multi-channel audio service.

Further, when the number of channels increases, a magnitude of a matrix used for downmixing and upmixing at one time becomes great to result in an increase in complexity in calculation. Further, sound quality also may require enhancement to match an increased number of channels in order to improve reality.

SUMMARY

The foregoing and/or other aspects are achieved by providing an apparatus of encoding a multi-channel audio signal, the apparatus including a channel grouping unit to group channels based on a channel characteristic of the multi-channel audio signal, a signal converter to eliminate redundant information between the grouped channels and to convert a frequency of the multi-channel audio signal, a quantization unit to quantize the frequency-converted multi-channel audio signal, and an encoder to encode the quantized multi-channel audio signal.

According to example embodiments, the apparatus of encoding the multi-channel audio signal may further include a domain transformer to transform a multi-channel audio signal in each group into a domain expressed by a complex number coefficient, and a matrix generation unit to generate a mixing matrix eliminating redundant information about the multi-channel audio signal converted into the domain between channels.

According to example embodiments, there is provided a method of encoding a multi-channel audio signal, the method including grouping channels based on a channel characteristic of the multi-channel audio signal, eliminating redundant information between the grouped channels and converting a frequency of the multi-channel audio signal, quantizing the frequency-converted multi-channel audio signal, and encoding the quantized multi-channel audio signal.

According to example embodiments, the method of encoding the multi-channel audio signal may further include transforming a multi-channel audio signal in each group into a domain expressed by a complex number coefficient, and generating a mixing matrix eliminating redundant information about the multi-channel audio signal converted into the domain between channels.

According to example embodiments, channels of multi-channel audio signals are grouped in advance and redundant information between the channels is eliminated, thereby reducing additional information about a matrix and decreasing complexity.

According to example embodiments, redundant information between channels is eliminated using a mixing matrix including phase information to improve ambience when a multi-channel sound.

Additional aspects of embodiments will be set forth in part in the description which follows and, in part, will be apparent from the description, or may be learned by practice of the disclosure.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
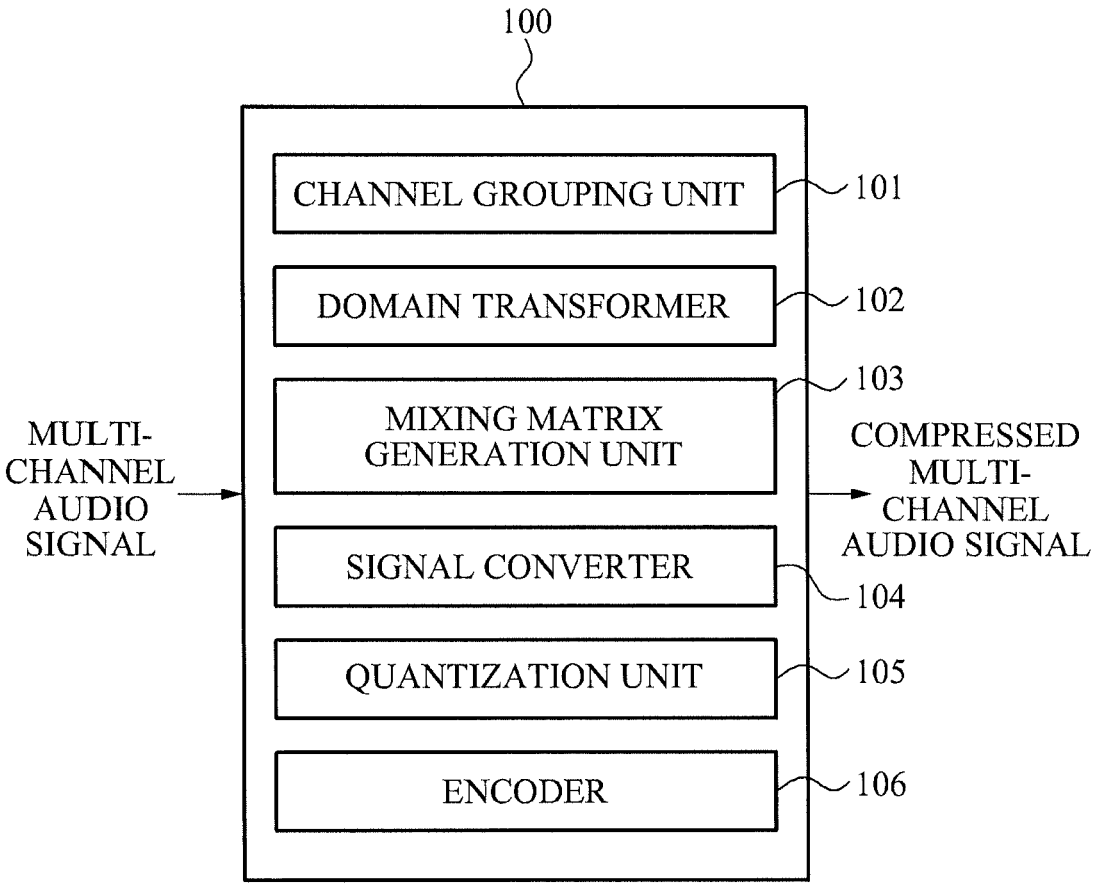
FIG. 1 is a block diagram illustrating an overall configuration of a multi-channel audio signal encoding apparatus according to example embodiments.

Reference will now be made in detail to embodiments, examples of which are illustrated in the accompanying drawings, wherein like reference numerals refer to the like elements throughout. Embodiments are described below to explain the present disclosure by referring to the figures. A method of encoding a multi-channel audio signal according to example embodiments may be performed by an apparatus of encoding a multi-channel audio signal. Although not mentioned in the specification, an apparatus of decoding a multi-channel audio signal performs an inverse operation to an operation of the apparatus of encoding the multi-channel audio signal to reconstruct an original signal. Hereinafter, description will be made on the apparatus of encoding the multi-channel audio signal.

FIG. 1 is a block diagram illustrating an overall configuration of a multi-channel audio signal encoding apparatus according to example embodiments.

Referring to FIG. 1, the multi-channel audio signal encoding apparatus 100 includes a channel grouping unit 101, a domain transformer 102, a matrix generation unit 103, a signal converter 104, a quantization unit 105, and an encoder 106.

The channel grouping unit 101 may group channels based on a channel characteristic of a multi-channel audio signal.

The channel grouping unit 101 may determine a group criterion using a multi-channel psychoacoustic model.

For example, the channel grouping unit 101 may group channels using a geometric structure of a multi-channel audio signal in each channel. Alternatively, the channel grouping unit 101 may group channels using a similarity of a multi-channel audio signal between channels. A process of grouping channels will be described further with reference to FIGS. 3 and 4.

The domain transformer 102 may transform a multi-channel audio signal in each group into a domain expressed by a complex number coefficient. For example, the domain transformer 102 may perform domain transformation using one of a Complex Quadrature Mirror Filter (QMF), and a Modified Discrete Cosine Transform (MDCT) & Modified Discrete Sine Transform (MDST).

The matrix generation unit 103 may generate a mixing matrix to eliminate redundant information about a multi-channel audio signal transformed into a domain between channels. For example, the matrix generation unit 103 generates a mixing matrix in each frequency band using Karhunen-Loeve Transform (KLT).

The signal converter 104 eliminates redundant information between grouped channels using a mixing matrix and converts a frequency of a multi-channel audio signal.

The quantization unit 105 quantizes a frequency-converted multi-channel audio signal.

The encoder 106 encodes a quantized multi-channel audio signal. The encoder 106 may also encode a mixing matrix. Here, the encoder 106 may encode a coefficient of a mixing matrix separately in a phase and a magnitude. In further detail, the encoder 106 may encode a phase using a room response expressed by a peak and a slope based on information about a phase between bands.

Figure 2:
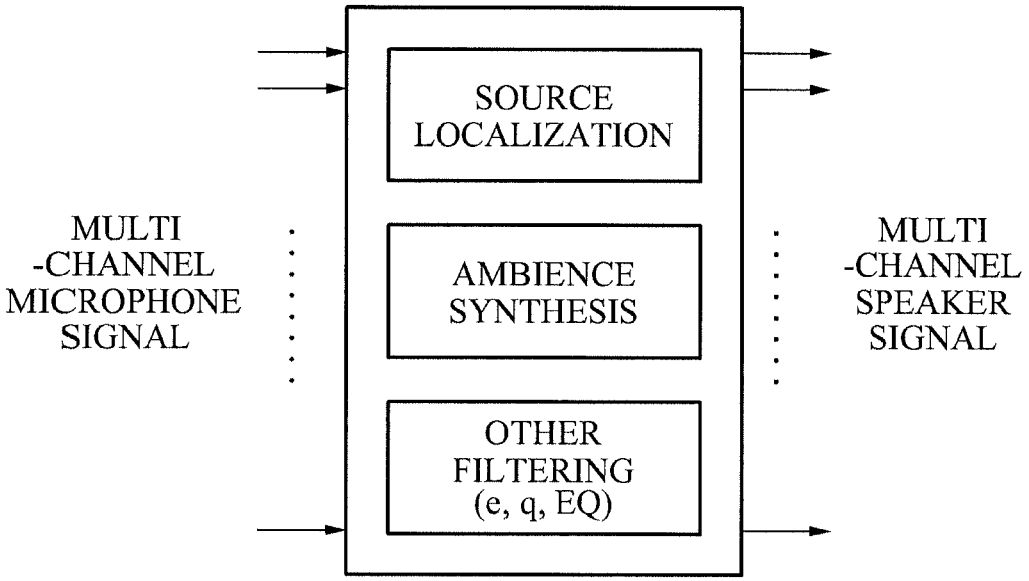
FIG. 2 illustrates a process of generating a multi-channel audio signal according to example embodiments.

FIG. 2 illustrates a process of generating a multi-channel audio signal according to example embodiments.

FIG. 2 illustrates an example of the process of generating the multi-channel audio signal. A multi-channel audio signal is generated from audio signals collected by a plurality of microphones. Here, localization, ambience synthesis, and equalization filtering are properly applied to the audio signals collected by the microphones to generate the multi-channel audio signal. Here, localization may be expressed by an energy ratio. Ambience may be generated through all-pass filtering.

Figure 3:
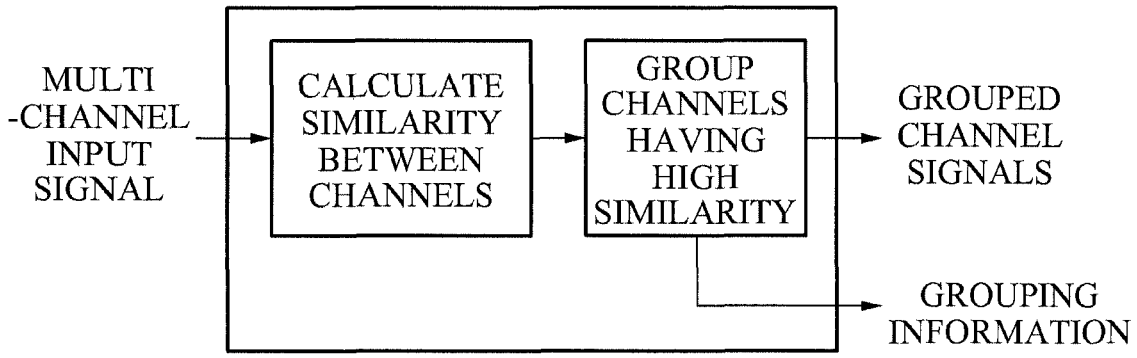
FIG. 3 illustrates a process of grouping multi-channel audio signals according to example embodiments.

FIG. 3 illustrates a process of grouping multi-channel audio signals according to example embodiments.

Referring to FIG. 3, when multi-channel audio signals are input, the channel grouping unit 101 calculates a similarity between channels and groups channels having a high similarity. Then, the channel grouping unit 101 may generate a signal of a grouped channel and grouping information. The grouping information may include a number of groups and information about a group index of each channel. The channel grouping unit 101 groups the input multi-channel audio signals in advance and processes channels into respective groups, so that additional information about a mixing matrix and complexity of calculation may be decreased.

Here, the channel grouping unit 101 may group the channels of the multi-channel audio signals using a geometric structure of a multi-channel audio signal in each channel. Here, a geometric structure denotes a layout of each channel. Further, the channel grouping unit 101 may group the channels of the multi-channel audio signals using a similarity of multi-channel audio signals between channels.

Figure 4:
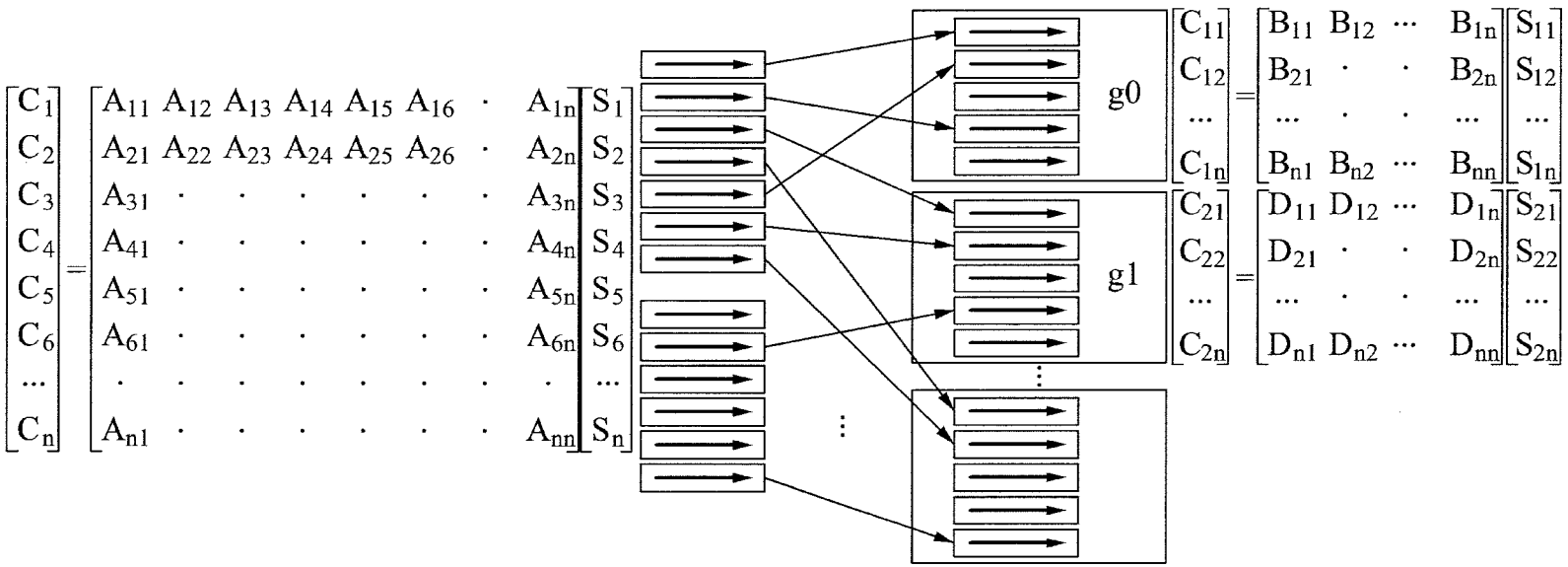
FIG. 4 illustrates a process of grouping multi-channel audio signals and generating a mixing matrix according to example embodiments.

FIG. 4 illustrates a process of grouping multi-channel audio signals and generating a mixing matrix according to example embodiments.

First, when multi-channel audio signals are input, the channel grouping unit 101 groups channels. In FIG. 4, grouped results are expressed as g0 and 01. The domain transformer 102 may transform a multi-channel audio signal in each group into a domain expressed by a complex number coefficient. Here, the domain transformer 102 may transform the multi-channel audio signal through a complex valued filter bank. The complex valued filter bank may include a complex-valued QMF or an MDCT & MDST.

The matrix generation unit 103 may generate a mixing matrix to eliminate redundant information about a multi-channel audio signal transformed into a domain between channels. That is, when the mixing matrix is applied to a group, channels included in the group have a correlation. The above process is referred to as inter-channel processing.

Here, the mixing matrix is generated in each group. For example, the mixing matrix is used for downmixing or upmixing of an audio signal in each channel. Here, the mixing matrix may be generated in each frequency band using the Karhunen-Loeve Transform (KLT).

Each coefficient of the mixing matrix is a complex number and may be calculated using an eigenvector. The coefficient of the mixing matrix may be divided into a magnitude and a phase. The mixing matrix is expressed by the following Equation 1.

$$M_j = \begin{bmatrix} m_{00} & m_{01} & m_{02} & \cdots \\ m_{10} & \cdots & \cdots & \cdots \\ m_{20} & \cdots & \cdots & \cdots \\ \cdots & & & m_{NN} \end{bmatrix} \quad \text{[Equation 1]}$$

In Equation 1, N represents a number of channels included in a group, and j represents an index of a frequency band. When the mixing matrix is divided into a magnitude and a phase, the mixing matrix is expressed by the following Equation 2.

[Equation 2]

$$M_j = \begin{bmatrix} |m_{00}| \cdot e^{j\angle m_{00}} & |m_{01}| \cdot e^{j\angle m_{01}} & |m_{02}| \cdot e^{j\angle m_{02}} & \cdots \\ |m_{10}| \cdot e^{j\angle m_{10}} & \cdots & \cdots & \cdots \\ |m_{20}| \cdot e^{j\angle m_{20}} & \cdots & \cdots & \cdots \\ \cdots & & & |m_{NN}| \cdot e^{j\angle m_{NN}} \end{bmatrix}$$

A phase of the mixing matrix, expressed by Equation 2, in each frequency band is expressed by the following Equation 3.

$$\theta_{00} = [\angle m_{00,0} \angle m_{00,1} \ldots \angle m_{00,J}] \quad \text{[Equation 3]}$$

Here, J represents a total number of bands, and Equation 3 denotes phase information corresponding to a mixing matrix (0, 0). The phase information corresponds to a room response and may be expressed in each frequency band by a slope and a peak.

Then, the signal converter 104 may convert a frequency of a multi-channel audio signal in each group for encoding. For example, when the domain transformer 102 analyzes a multi-channel audio signal by using a complex QMF, the signal converter 104 transforms the multi-channel audio signal via inter-channel processing into a time domain through a complex QMF synthesis and then converts a frequency of the multi-channel audio signal by applying an MDCT.

Alternatively, when the domain transformer 102 analyzes a multi-channel audio signal by using a complex QMF, the signal converter 104 performs inter-channel processing through a complex QMF and converts a frequency by applying an MDCT to a sub-sample of a complex QMF.

Alternatively, the domain transformer 102 applies an MDCT and MDST to a multi-channel audio signal, and the signal converter 104 selects only an MDCT that is a real number from the multi-channel audio signal via inter-channel processing and converts a frequency of the multi-channel audio signal. Here, in a decoding process, an MDST coefficient is extracted from an MDCT coefficient for inverse inter-channel processing.

The quantization unit 105 may quantize a multi-channel audio signal via a mixing matrix, phase information corresponding to a room response and inter-channel processing using psychoacoustic information. Here, quantization information may be quantized along with a coefficient of a mixing matrix in each channel.

For example, a case where a $j^{th}$ band in a channel i has a quantization coefficient of 100, and a case where a corresponding coefficient of a mixing matrix is [0.1 0.3 0.5 0-0.2], exist. Then, a quantization coefficient is expressed by the following Equation 4.

$$scalefactor_{i,j} = 10^{\frac{-100}{4}} \quad \text{[Equation 4]}$$

A coefficient of a mixing matrix and a quantization coefficient may be encoded independently. Instead, the quantization coefficient may be included in the quantization coefficient of the mixing matrix and transmitted as shown in FIG. 5.

$$m_i = \left[ 0.1 \cdot 10^{\frac{-100}{4}} \quad 0.3 \cdot 10^{\frac{-100}{4}} \quad 0.5 \cdot 10^{\frac{-100}{4}} \quad 0 \quad -0.2 \cdot 10^{\frac{-100}{4}} \right] \quad \text{[Equation 5]}$$

Then, the decoding apparatus may perform inverse quantization simultaneously with mixing using the transmitted coefficient of the mixing matrix.

Figure 5:
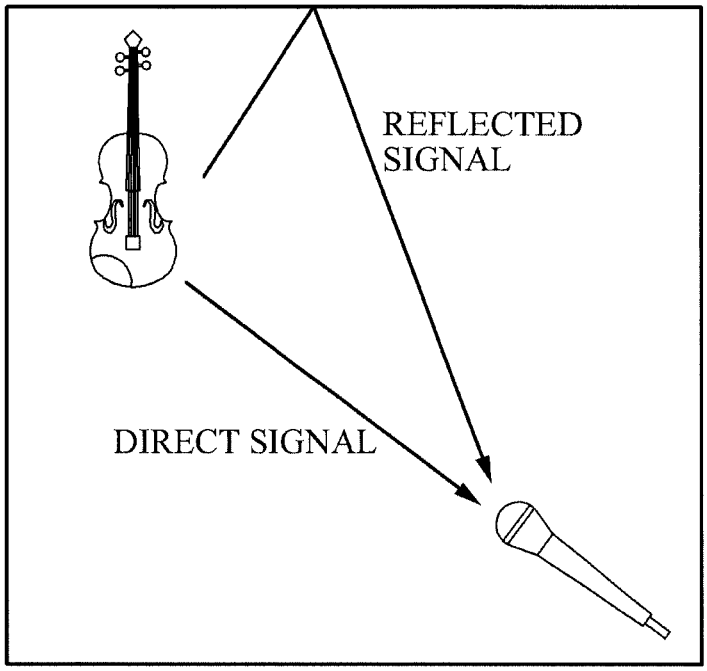
FIG. 5 illustrates a room response according to example embodiments.

FIG. 5 illustrates a room response according to example embodiments.

When an audio signal is collected from an instrument in a space, an audio signal to be output to each channel of a multi-channel audio signal is generated based on information reflection and attenuation due to the space. When reflection is modeled in a room with information about the space being known beforehand, a sound having quality similar to an original sound may be provided using one sound source and information about the room through rendering.

Figure 6:
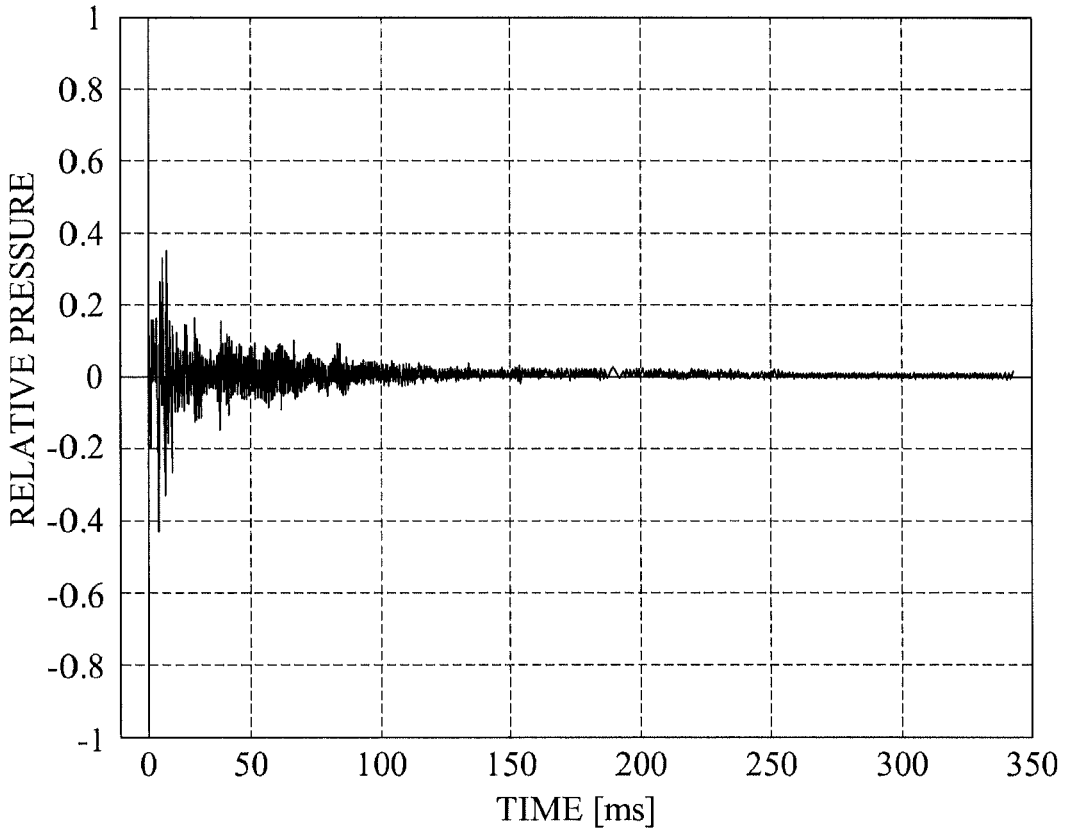
FIG. 6 illustrates a room response over time according to example embodiments.

FIG. 6 illustrates a room response over time according to example embodiments. In further detail, FIG. 6 illustrates an impulse response of the room response. An initial response is associated to an audio signal collected immediately, and a subsequent response is associated to an audio signal collected through reflection in the room.

Figure 7:
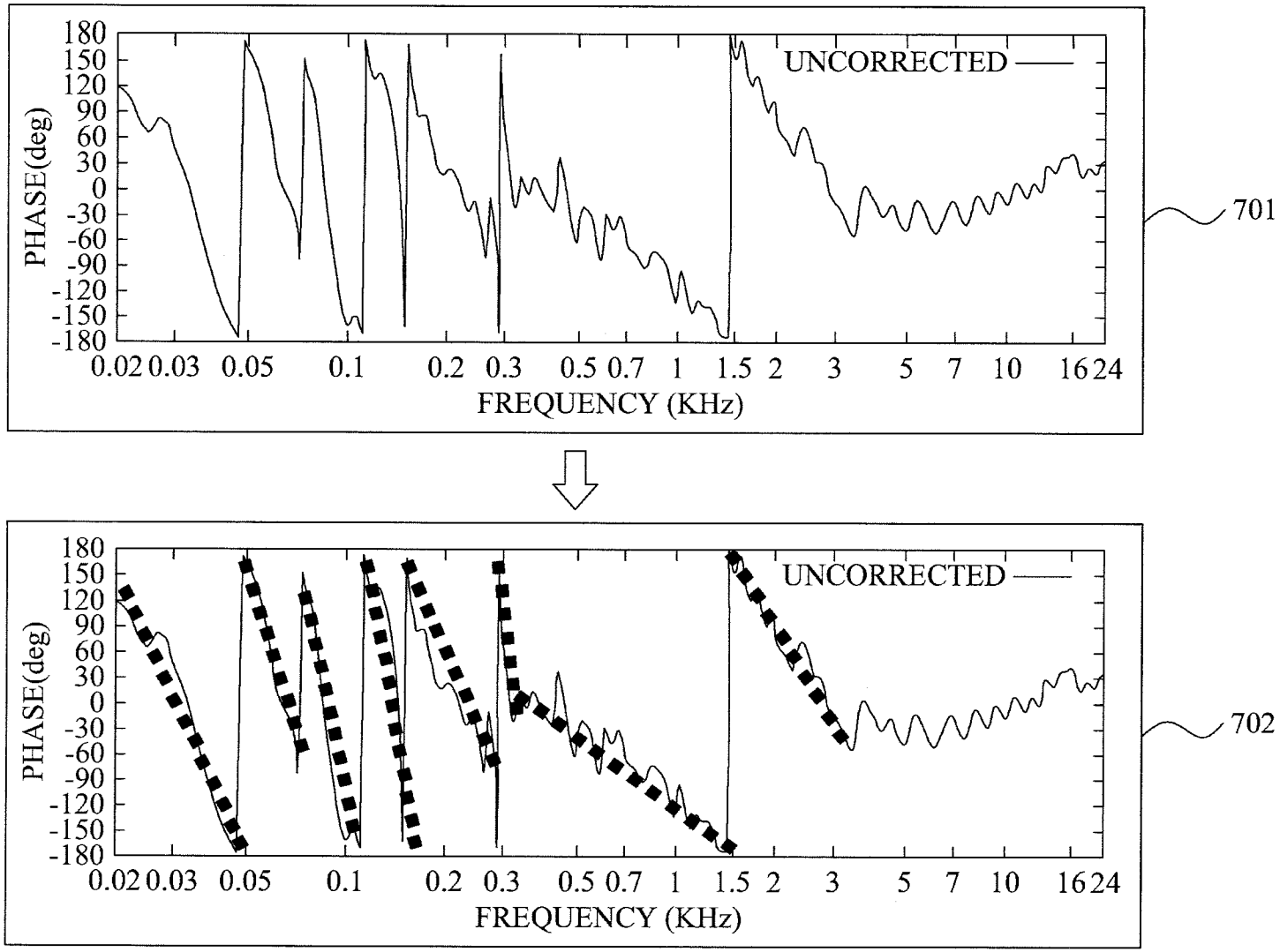
FIG. 7 illustrates a process of modeling a phase response of a room response according to example embodiments.

FIG. 7 illustrates a process of modeling a phase response of a room response according to example embodiments.

A graph 701 illustrates information about a phase of the room response in each frequency band. When the phase exceeds a PI, the phase is expressed by a −PI due to a cyclic phase. Referring to the graph 701, the phase is different in each frequency band, and a time lag exists.

The information about the phase may be expressed by a peak and a slope as shown in a graph 702. The encoding apparatus predicts the information about the phase and transmits the information to the decoding apparatus as additional information. Then, a reconstructed signal maintains ambience of a multi-channel audio signal.

Figure 8:
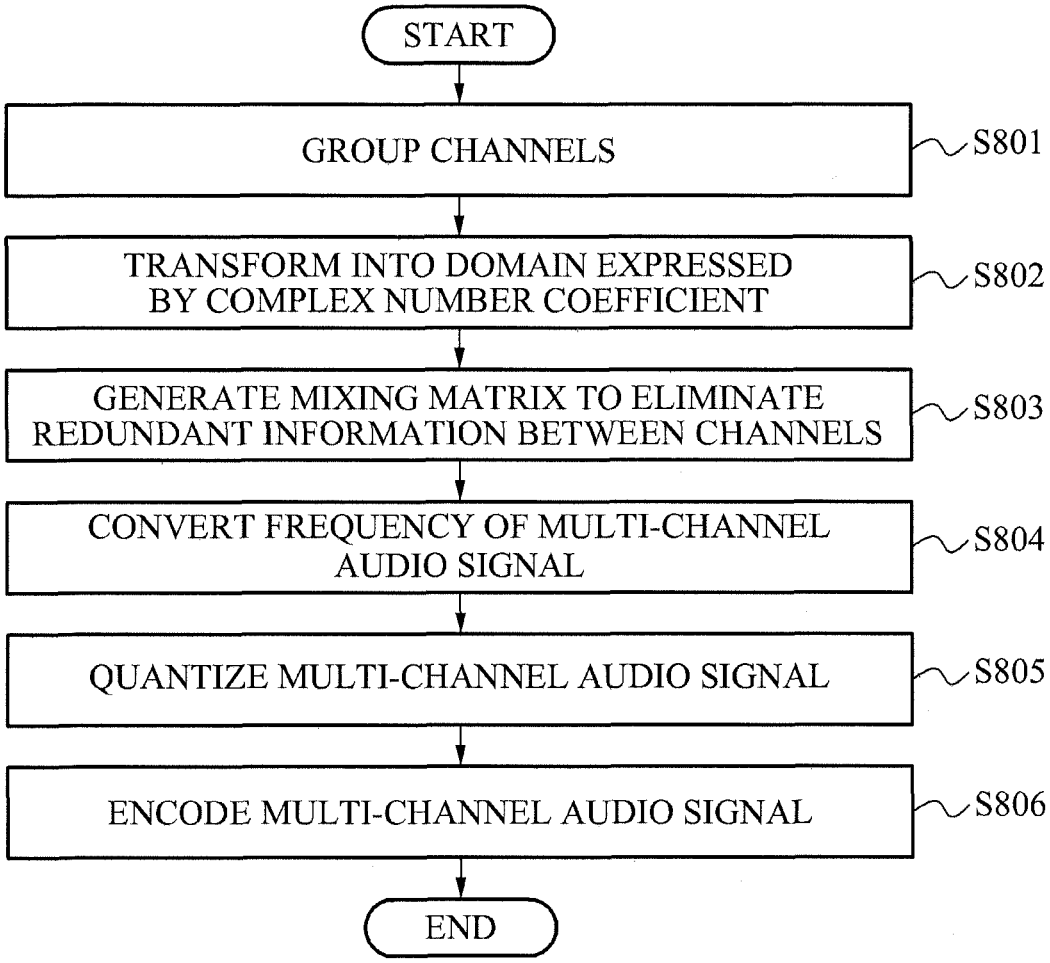
FIG. 8 is a flowchart illustrating a method of encoding a multi-channel audio signal according to example embodiments.

FIG. 8 is a flowchart illustrating a method of encoding a multi-channel audio signal according to example embodiments. A method of decoding a multi-channel audio signal is an inverse process to a process of FIG. 8.

The multi-channel audio signal encoding apparatus 100 may group channels of a multi-channel audio signal based on a channel characteristic of the multi-channel audio signal in operation S801.

For example, the multi-channel audio signal encoding apparatus 100 may perform channel grouping using a geometric structure of the multi-channel audio signal in each channel. Alternatively, the multi-channel audio signal encoding apparatus 100 may perform channel grouping using a similarity of the multi-channel audio signal between channels. Here, the multi-channel audio signal encoding apparatus 100 may determine a group criterion using a multi-channel psychoacoustic model.

The multi-channel audio signal encoding apparatus 100 may transform the multi-channel audio signal in each group into a domain expressed by a complex number coefficient in operation S802. Here, the multi-channel audio signal encoding apparatus 100 may perform domain transformation using one of a complex QMF or an MDCT & MOST.

The multi-channel audio signal encoding apparatus 100 may generate a mixing matrix in operation S803 to eliminate redundant information about the multi-channel audio signal transformed into the domain between channels. For example, the multi-channel audio signal encoding apparatus 100 may generate a mixing matrix in each frequency band using KLT.

The multi-channel audio signal encoding apparatus 100 may eliminate redundant information between grouped channels and convert a frequency of the multi-channel audio signal in operation S804. Here, the multi-channel audio signal encoding apparatus 100 may convert the frequency of the multi-channel audio signal by applying the mixing matrix.

The multi-channel audio signal encoding apparatus 100 may quantize the frequency-converted multi-channel audio signal in operation S805.

The multi-channel audio signal encoding apparatus 100 may encode the quantized multi-channel audio signal in operation S806. The multi-channel audio signal encoding apparatus 100 may encode a phase using a room response expressed by a peak and a slope based on information about a phase between bands.

The apparatus and the method for encoding and decoding the multi-channel audio signal according to the above-described embodiments may be embodied in a computer and recorded in non-transitory computer-readable media including program instructions to implement various operations embodied by a computer. The media may also include, alone or in combination with the program instructions, data files, data structures, and the like. Examples of non-transitory computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations of the above-described embodiments, or vice versa.

Although embodiments have been shown and described, it would be appreciated by those skilled in the art that changes may be made in these embodiments without departing from the principles and spirit of the disclosure, the scope of which is defined by the claims and their equivalents.

What is claimed is:

1. An apparatus encoding a multi-channel audio signal, the apparatus comprising:

a channel grouping unit to group channels based on a channel characteristic of the multi-channel audio signal;

a signal converter to eliminate redundant information between the grouped channels using the mixing matrix and to convert a frequency of the multi-channel audio signal having the grouped channels exclusive of the redundant information to produce a frequency-converted multi-channel audio signal;

a quantization unit to quantize the frequency-converted multi-channel audio signal to produce a quantized multi-channel audio signal; and an encoder to encode the quantized multi-channel audio signal and the mixing matrix, wherein the mixing matrix is generated in each group.

2. The apparatus of claim 1, wherein the channel grouping unit groups channels using a geometric structure of the multi-channel audio signal in each channel.

3. The apparatus of claim 1, wherein the channel grouping unit groups channels using a similarity between channels of the multi-channel audio signal.

4. The apparatus of claim 1, wherein the channel grouping unit determines a group criterion using a multi-channel psychoacoustic model.

5. The apparatus of claim 1, further comprising:

a domain transformer to transform the multi-channel audio signal in each group into a domain expressed by a complex number coefficient; and a matrix generation unit to generate a mixing matrix eliminating redundant information about the multi-channel audio signal converted into the domain between channels, wherein the signal converter applies the mixing matrix and converts the frequency of the multi-channel audio signal.

6. The apparatus of claim 5, wherein the matrix generation unit generates a mixing matrix in each frequency band using a Karhunen-Loeve Transform (KLT).

7. The apparatus of claim 5, wherein the encoder encodes a coefficient of the mixing matrix separately in a phase and a magnitude.

8. The apparatus of claim 7, wherein the encoder encodes the phase using a room response expressed by a peak and a slope based on phase information between bands.

9. The apparatus of claim 5, wherein the domain transformer performs domain transformation using one of a Complex Quadrature Mirror Filter (QMF) and a Modified Discrete Cosine Transform (MDCT) & Modified Discrete Sine Transform (MDST).

10. The apparatus of claim 1, wherein the quantization unit includes a mixing coefficient in a quantization coefficient and quantizes at a same time.

11. A method of encoding a multi-channel audio signal, the method comprising:

grouping channels based on a channel characteristic of the multi-channel audio signal;

eliminating redundant information between the grouped channels using the mixing matrix and converting a frequency of the multi-channel audio signal having the grouped channels exclusive of the redundant information to produce a frequency-converted multi-channel audio signal;

quantizing the frequency-converted multi-channel audio signal to produce a quantized multi-channel audio signal; and encoding the quantized multi-channel audio signal and the mixing matrix, wherein the mixing matrix is generated in each group.

12. The method of claim 11, wherein the grouping of the channels groups channels using a geometric structure of the multi-channel audio signal in each channel.

13. The method of claim 11, wherein the grouping of the channels groups channels using a similarity between channels of the multi-channel audio signal.

14. The method of claim 11, wherein the grouping of the channels determines a group criterion using a multi-channel psychoacoustic model.

15. The method of claim 11, further comprising:

transforming the multi-channel audio signal in each group into a domain expressed by a complex number coefficient; and generating a mixing matrix eliminating redundant information about the multi-channel audio signal converted into the domain between channels, wherein the converting of the frequency of the multi-channel audio signal applies the mixing matrix and converts the frequency of the multi-channel audio signal.

16. The method of claim 15, wherein the generating of the mixing matrix generates a mixing matrix in each frequency band using a Karhunen-Loeve Transform (KLT).

17. The method of claim 15, wherein an encoder encodes a coefficient of the mixing matrix separately in a phase and a magnitude.

18. The method of claim 17, wherein the encoding of the quantized multi-channel audio signal encodes the phase using a room response expressed by a peak and a slope based on phase information between bands.

19. The method of claim 15, wherein the transforming the multi-channel audio signal in each group into the domain expressed by a complex number coefficient performs domain transformation using one of a Complex Quadrature Mirror Filter (QMF), and a Modified Discrete Cosine Transform (MDCT) & Modified Discrete Sine Transform (MDST).

20. A non-transitory computer-readable medium comprising a program for instructing a computer to perform the method of claim 11.

* * * * *